US009802100B2

(12) United States Patent
Csencsits et al.

(10) Patent No.: US 9,802,100 B2
(45) Date of Patent: Oct. 31, 2017

(54) DYNAMIC POSITIONING GOLF TRAINING APPARATUS

(71) Applicants: Mark Csencsits, Bethlehem, PA (US); Christopher Michael Albright, Allentown, PA (US)

(72) Inventors: Mark Csencsits, Bethlehem, PA (US); Christopher Michael Albright, Allentown, PA (US)

(73) Assignee: Fatt Matt, LLC, Allentown, PA (US)

( * ) Notice: Subject to any disclaimer, the term of this patent is extended or adjusted under 35 U.S.C. 154(b) by 0 days.

(21) Appl. No.: 15/043,746

(22) Filed: Feb. 15, 2016

(65) Prior Publication Data

US 2017/0232321 A1 Aug. 17, 2017

(51) Int. Cl.
*A63B 69/36* (2006.01)

(52) U.S. Cl.
CPC .. *A63B 69/3667* (2013.01); *A63B 2208/0204* (2013.01)

(58) Field of Classification Search
USPC ..... 473/160, 161, 266, 269, 270, 272, 278, 473/279
See application file for complete search history.

(56) References Cited

U.S. PATENT DOCUMENTS 2,879,996 A * 3/1959 Lederer ..... A63B 69/3652 248/182.1
5,720,670 A 2/1998 Oxley et al.
5,820,478 A 10/1998 Wood et al.
5,944,615 A * 8/1999 Lee ..... A63B 69/3652 473/279
5,957,788 A * 9/1999 Eze ..... A63B 69/0091 473/422
6,312,345 B1 11/2001 Pelz
6,450,895 B1 * 9/2002 Galluzzo, Jr. ..... A63B 69/3652 473/279
6,663,498 B2 12/2003 Stipan
7,993,249 B1 * 8/2011 Fassl ..... A63B 69/0002 473/451
8,496,538 B1 7/2013 Tyler
9,011,264 B2 4/2015 Tang
2002/0128084 A1 9/2002 Lee et al.
2004/0110570 A1 6/2004 Hutchon et al.
2005/0113182 A1 * 5/2005 Kim ..... A63B 69/3673 473/279
2006/0205528 A1 * 9/2006 McMillan ..... A63B 23/0488 473/279
2009/0023523 A1 * 1/2009 Poillucci ..... A63B 47/007 473/478
2015/0005083 A1 1/2015 Tang

* cited by examiner

*Primary Examiner* — Nini Legesse
(74) *Attorney, Agent, or Firm* — Gregory Finch

(57) ABSTRACT

An apparatus to enable golfers to practice uneven golf shots. According to embodiments of the present disclosure, a golf training apparatus is generally comprised of a foot platform and a ball platform that may be dynamically positioned. The golf training apparatus enables the golfer to practice balance and technique for uneven golf shots by manipulating both the plane of the golfer's stance as well as the position of the ball.

4 Claims, 7 Drawing Sheets

DYNAMIC POSITIONING GOLF TRAINING APPARATUS

FIELD

The present disclosure relates to the field of golf training aids; in particular, an apparatus to enable golfers to practice uneven golf shots.

BACKGROUND

Regular practice is essential to achieving competency in the game of golf. Golfing centers offering the golfer hitting areas to practice and improve their game are highly popular. Such practice areas, often called driving ranges, often employ synthetic mats off of which a ball may be hit with a club. Unfortunately, many artificial golf hitting areas do not allow for the golfer to control the horizontal and vertical orientation of the golf ball to better emulate the conditions golfers experience on a golf course.

Various prior art solutions exist to create a practice device where the surface thereof can be adjusted in some way so as to vary its angle relative to the horizontal in order to provide a more realistic practice surface for golfers. These devices can be difficult to operate, and are usually so heavy that they must essentially remain in one location because of the difficulty in moving them. They may require complicated and expensive hydraulic mechanisms to operate, electrical power for motors associated with the device, and metal framework to support the weight of the platform surface as well as the golfer when practicing.

Various devices for tilting golf practice platforms have been proposed. However, no solution currently exists that enables the golfer to independently alter the orientation and plane of both the golf ball and the golfer's stance. Nor is there a solution that provides these features in a light weight and portable construction. What is needed, therefore, is a golf practice apparatus that is both portable, and capable of manipulating the orientation and plane of a golfer's stance and the position of the golf ball. The inventors have developed a solution that is embodied by the present invention, which is described in detail below.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An embodiment of the present invention is a golf training apparatus comprising a foot platform, the foot platform comprising a right foot surface and a left foot surface, a right foot adjustment means and a left foot adjustment means operably engaged with the right foot surface and the left foot surface, and a foot platform base coupled to the right foot adjustment means and the left foot adjustment means; and, a ball platform, the ball platform comprising a ball surface, a ball surface adjustment means coupled to the ball surface, and a ball platform base coupled to the ball surface adjustment means.

Another embodiment of the present invention is golf training apparatus comprising a foot platform, the foot platform comprising a right foot surface and a left foot surface, a right foot adjustment means and a left foot adjustment means operably engaged with the right foot surface and the left foot surface, a foot platform base coupled to the right foot adjustment means and the left foot adjustment means, and an adjustable foot platform support means coupled to the foot platform base; and, a ball platform, the ball platform comprising a ball surface, a ball surface adjustment means coupled to the ball surface, a ball platform base coupled to the ball surface adjustment mean, and an adjustable ball platform support means coupled to the ball platform base.

Yet another embodiment of the present invention is a golf training apparatus comprising a foot platform, the foot platform comprising a right foot surface and a left foot surface, a right foot adjustment means and a left foot adjustment means operably coupled to the right foot surface and the left foot surface, a foot platform base coupled to the right foot adjustment means and the left foot adjustment means, an adjustable foot platform support means coupled to the foot platform base, and at least two wheels coupled to the foot platform base; and, a ball platform, the ball platform comprising a ball surface, a ball surface adjustment means coupled to the ball surface, a ball platform base coupled to the ball surface adjustment means, and an adjustable ball platform support means coupled to the ball platform base.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 1:
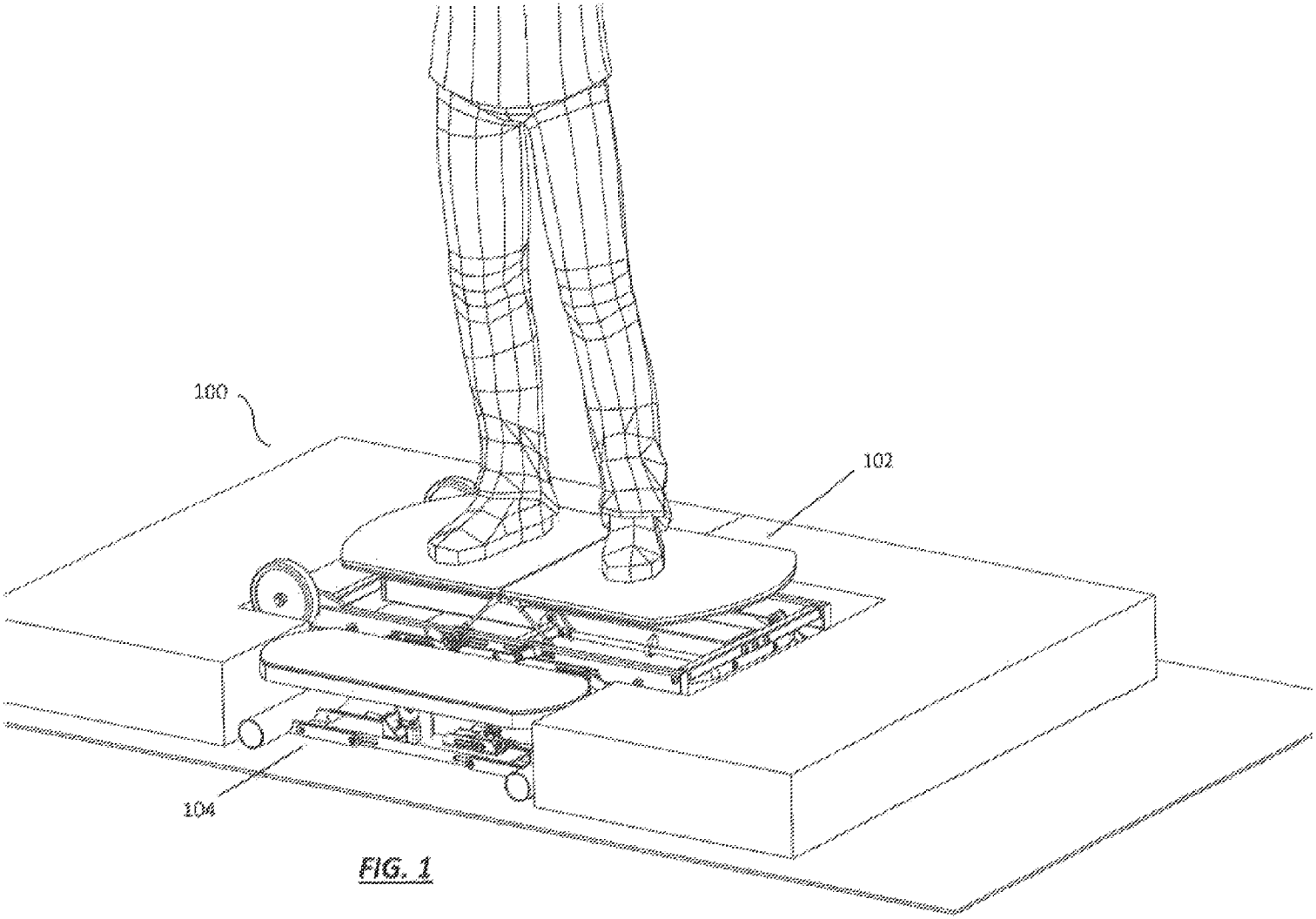
FIG. 1 is a perspective view of a golf training apparatus, according to an embodiment of the present disclosure.

Exemplary embodiments are described herein to provide a detailed description of the present disclosure. Variations of these embodiments will be apparent to those of skill in the art. Moreover, certain terminology is used in the following description for convenience only and is not limiting. For example, the words "right," "left," "top," "bottom," "upper," "lower," "inner" and "outer" designate directions in the drawings to which reference is made. The word "a" is defined to mean "at least one." The terminology includes the words above specifically mentioned, derivatives thereof, and words of similar import.

Referring now to FIG. 1, a perspective view of a golf training apparatus 100 is shown. According to an embodiment, golf training apparatus 100 is a two-part construction generally comprised of a foot platform 102 and a ball platform 104. Typically golfers practice at driving ranges with either a real or artificial hitting surface. Regardless of the type of surface, the vast majority of driving rages have the golfer practicing on a substantially flat surface. While golfers typically hit off a flat surface when hitting tee shots, they often experience uneven lies during play due to the numerous hills and valleys on many golf courses. Flat driving range surfaces do not enable the golfer to become accustomed to the necessary balance and hitting technique required to successfully execute uneven golf shots in a consistent manner. Golf training apparatus 100 enables the golfer to practice balance and technique for uneven golf shots by manipulating both the plane of the golfer's stance as well as the position of the ball.

Figure 2:
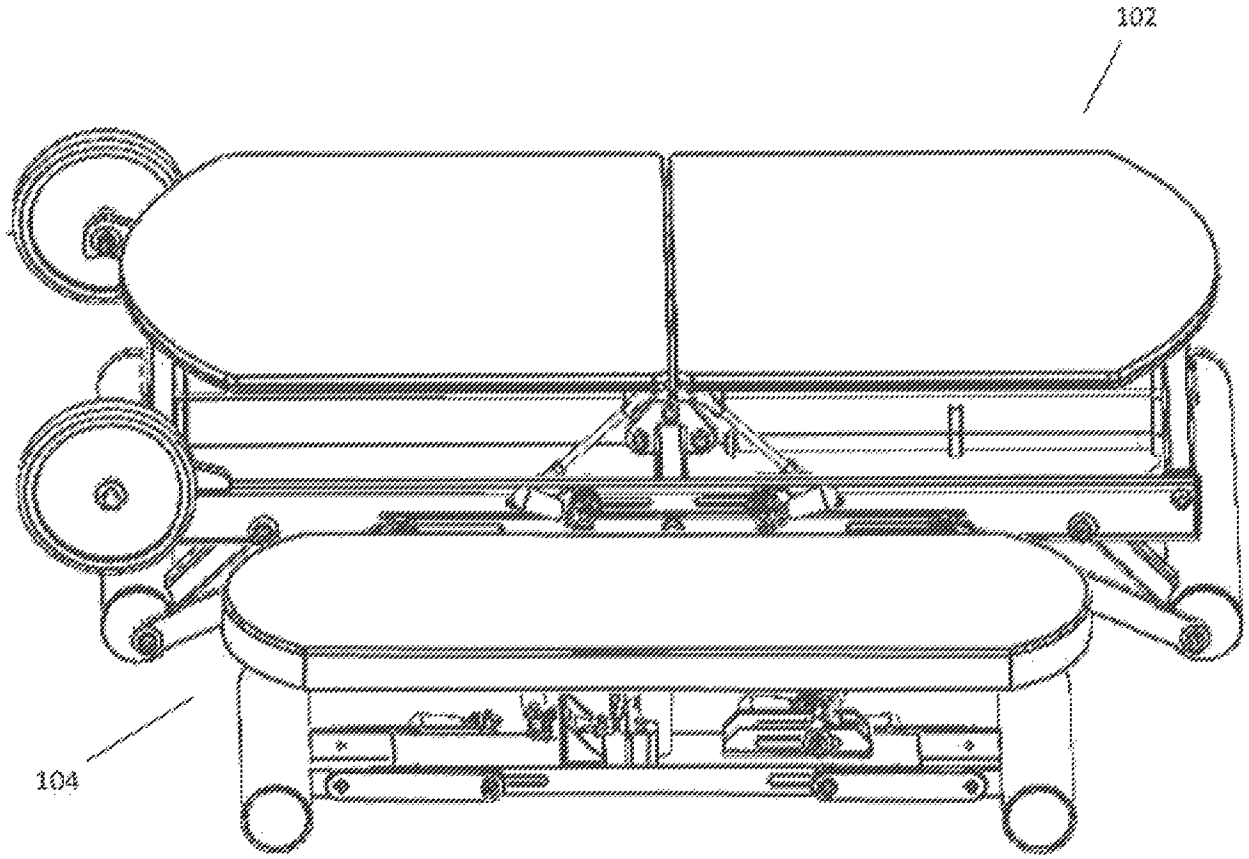
FIG. 2 is a perspective view of a golf training apparatus, according to an embodiment of the present disclosure.

FIG. 2 is a perspective view of foot platform 102 and a ball platform 104. A golfer stands on foot platform 102 when practicing a golf shot, while the golf ball rests on, and is struck from, ball platform 104. While standing on foot platform 102, the golfer strikes the golf ball resting on ball platform 104. Foot platform 102 can be manipulated in a variety of positions to simulate uphill, downhill and uneven golf shots. Ball platform 104 can be positioned according to a variety of configurations to correspond with the desired position of foot platform 102 to simulate the desired golf ball position, or lie, relative to the user's stance. Foot platform 102 and ball platform 104 may be portable and capable of being set up on a standard driving range surface. FIG. 2 shows foot platform 102 in an engaged position, and ball platform 104 in a flat position.

Figure 3:
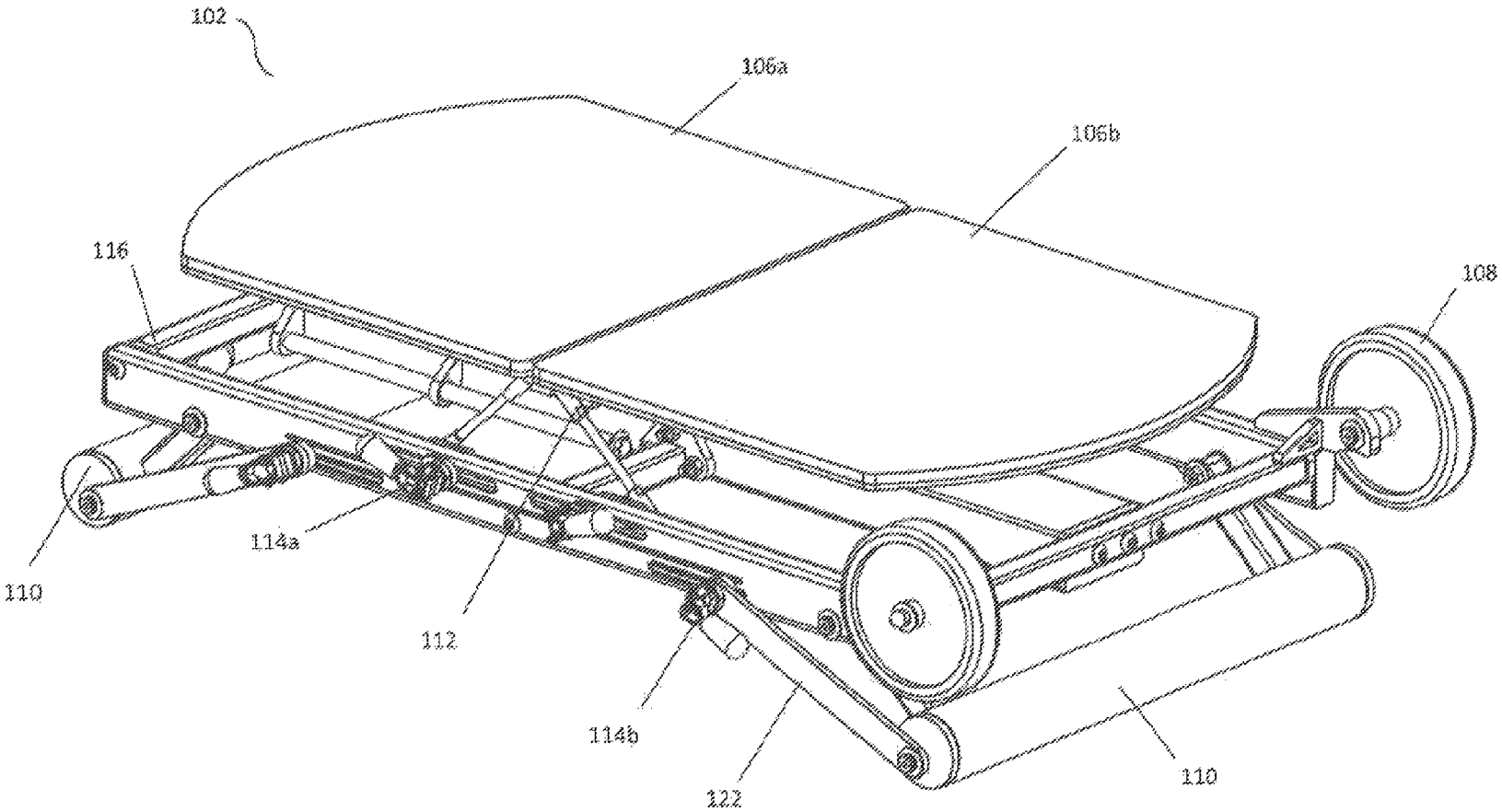
FIG. 3 is a perspective view of a foot platform of golf training apparatus in an engaged position, according to an embodiment of the present disclosure.

FIG. 3 is a perspective view of foot platform 102 in an engaged position. According to an embodiment of the present disclosure, foot platform 102 comprises a right foot surface 106*a* and a left foot surface 106*b*. The user may face either direction when standing on foot platform 102, and the designation of "right" and "left" is simply meant to illustrate that the user places each foot on an independent surface. As shown in an engaged position, support legs 110 are extended to provide support for foot platform 102 and to configure foot platform 102 to a desired height. Support leg lock 114*b* is engaged to hold support leg 110 in place via support arm 122. Right foot surface 106*a* and left foot surface 106*b* are configured in a desired position by disengaging adjustment arm lock 114*a* and setting adjustment arms 112 to a desired position. The desired position is held in place by engaging adjustment arm lock 114*a*. Support leg 110 and adjustment arms 112 are coupled to foot platform base 116, which provides structural support for foot platform 102

Figure 4:
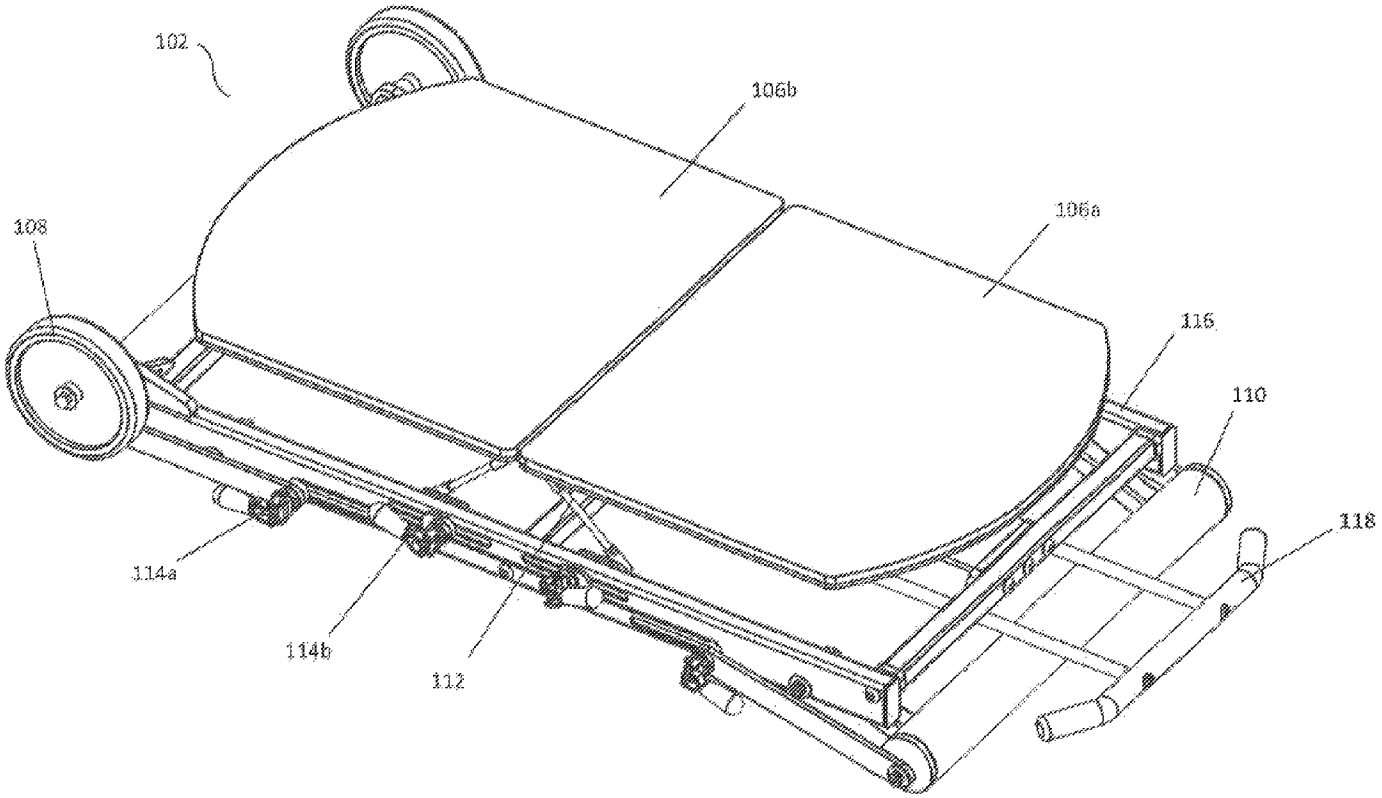
FIG. 4 is a perspective view of a foot platform of golf training apparatus in a collapsed position, according to an embodiment of the present disclosure.

FIG. 4 is a perspective view of foot platform 102 in a collapsed position, according to an embodiment of the present disclosure. When configured in a collapsed position, the user may easily transport foot platform 102 to and from the practice area. In the collapsed position, support legs 110 are positioned such that they are in contact with foot platform base 116. Wheels 108 are coupled to one end of foot platform base 116, and an extendable handle 118 is coupled to an opposite end of foot platform base 116. To transport foot platform 102, the user grips and lifts extendable handle 118 and rolls foot platform 102 via wheels 108. The user may then reconfigure foot platform 102 for use by configuring foot platform 102 as described in FIG. 3.

Figure 5:
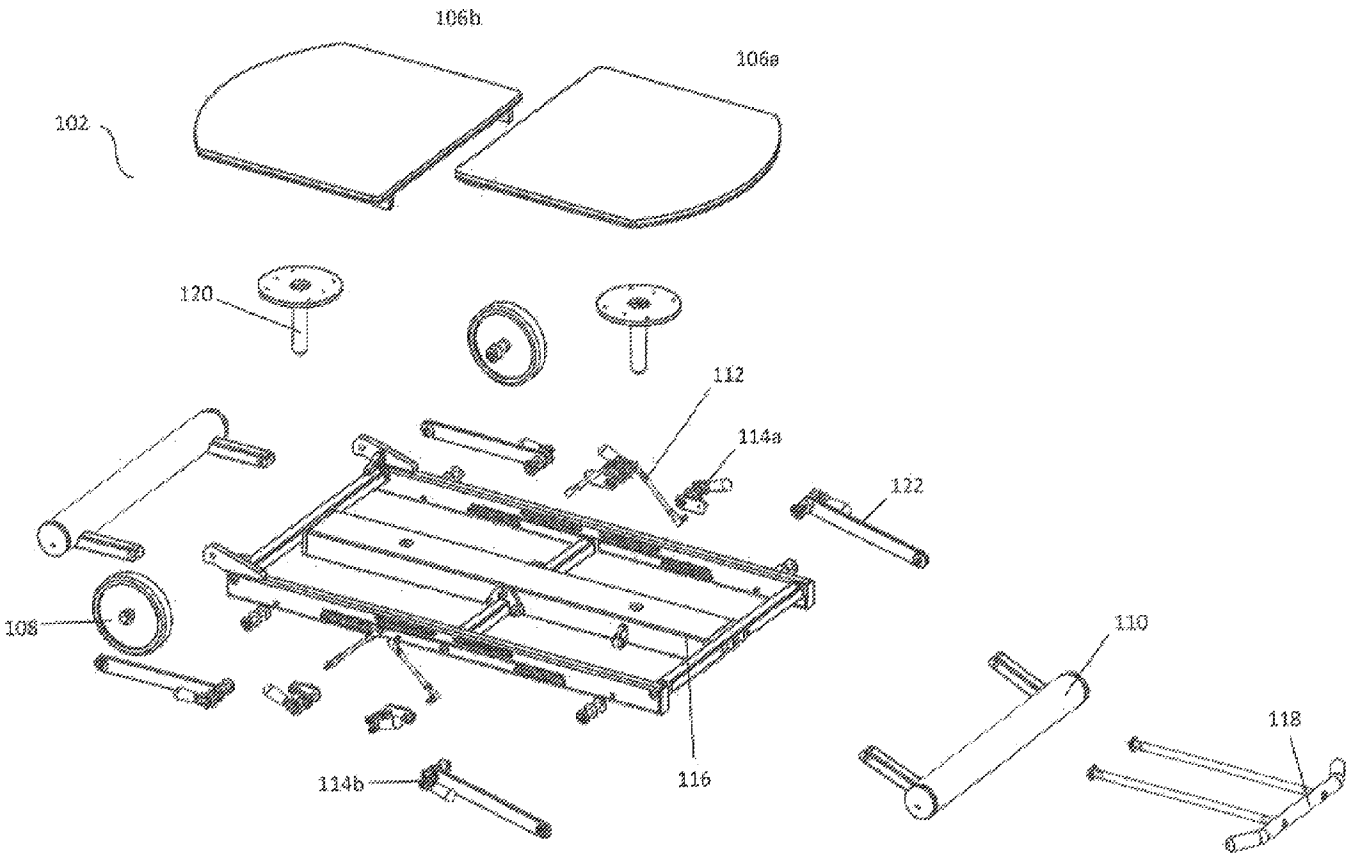
FIG. 5 is an exploded view of a foot platform of golf training apparatus, according to an embodiment of the present disclosure.

FIG. 5 is an exploded view of foot platform 102 illustrating the construction details of foot platform 102. According to an embodiment, foot platform 102 is generally comprised of right foot surface 106*a* and left foot surface 106*b*, which are coupled to foot surface connection 120. Foot surface connection 120 is coupled to foot platform base 116, and may have a spherical ball bearing fitting at the connection with foot platform base 116 such that foot surface connection 120 may be rotated and pivoted to alter the plane of right foot surface 106*a* and left foot surface 106*b*. Adjustment arms 112 is coupled to foot platform base 116 via adjustment arm lock 114*a*, and is coupled to an upper surface of foot surface connection 120. Adjustment arms 112 are operable to provide support for right foot surface 106*a* and left foot surface 106*b* when right foot surface 106*a* and left foot surface 106*b* are positioned in a desired configuration. When right foot surface 106*a* and left foot surface 106*b* are positioned in a desired configuration, adjustment arm lock 114*a* locks adjustment arms 112 in place and stabilizes right foot surface 106*a* and left foot surface 106*b*. Support legs 110 are coupled to foot platform base 116 and support arm 122. Support legs 110 and support arm 122 are secured in a desired position by support leg lock 114*b*. Wheels 108 are coupled to one end of foot platform base 116, and extendable handle 118 is coupled to an opposite end.

Figure 6:
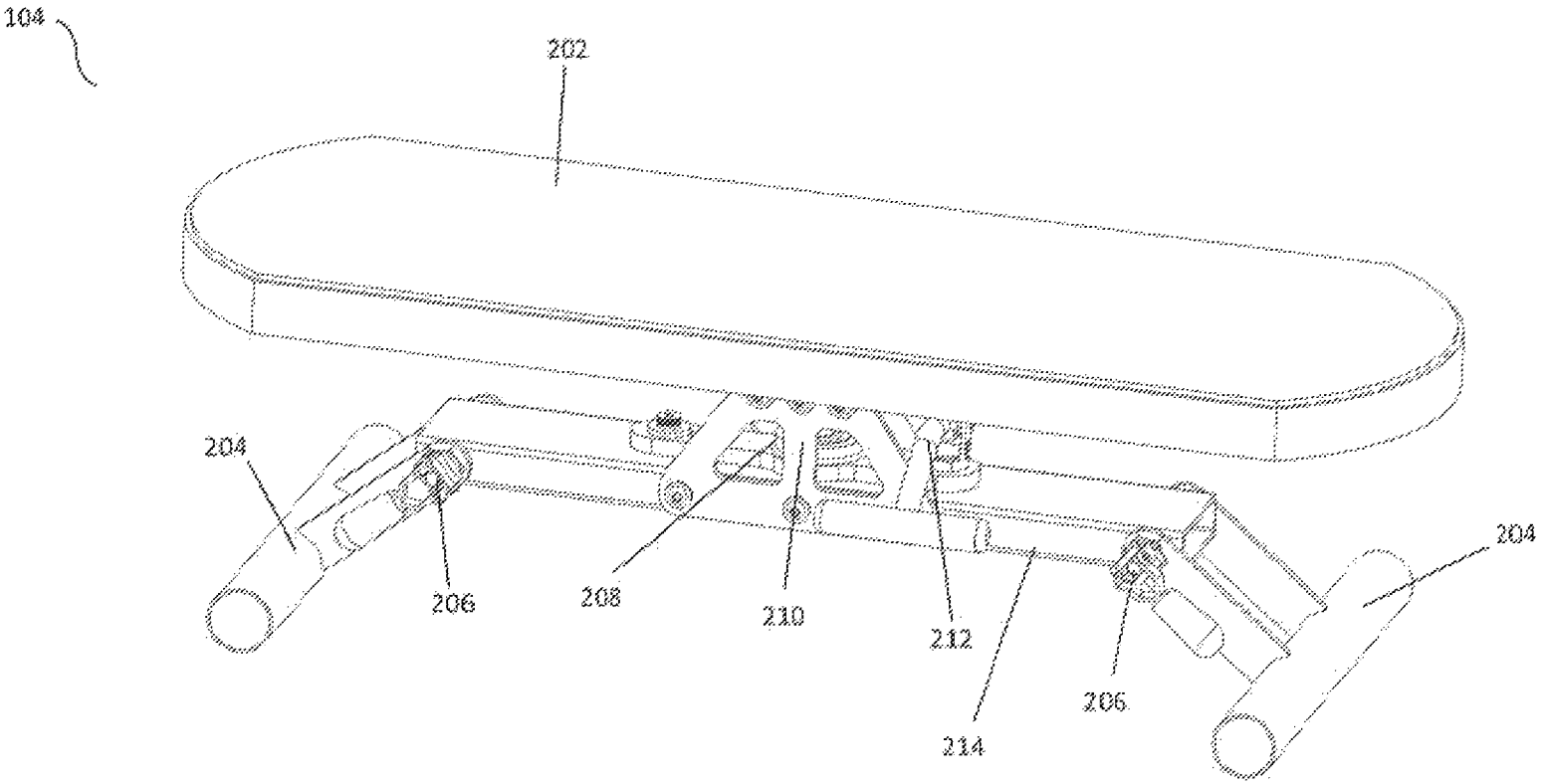
FIG. 6 a perspective view of a ball platform of golf training apparatus in an engaged position, according to an embodiment of the present disclosure; and, FIG. 7 is an exploded view of a ball platform of golf training apparatus, according to an embodiment of the present disclosure.

FIG. 6 is a perspective view of ball platform 104 of golf training apparatus 100 in an engaged position. According to an embodiment of the present disclosure, ball platform 104 is generally comprised of ball surface 202, ball platform support legs 204, support leg locks 206, ball surface connector 208, ball surface support bracket 210, ball surface adjustment handle 212, and ball platform base 214. To utilize ball platform 104, a user extends ball platform support legs 204 to a desired position and locks them in place with support leg locks 206, and adjusts ball surface 202 to a desired position and locks it in place with ball surface adjustment handle 212.

Ball surface 202 may have an artificial turf surface or other synthetic surface to mimic the feel of grass and hold a golf ball in place. Ball surface 202 is coupled to ball surface connector 208. Ball surface connector 208 may be configured such that it may enable ball surface 202 to be configured upward, downward and side-to-side. Ball surface connector 208 is coupled to ball platform base 214, and may be stabilized by ball surface support bracket 210. When adjusted to desired position, a user may place a golf ball on ball surface 202 for practice.

Figure 7:
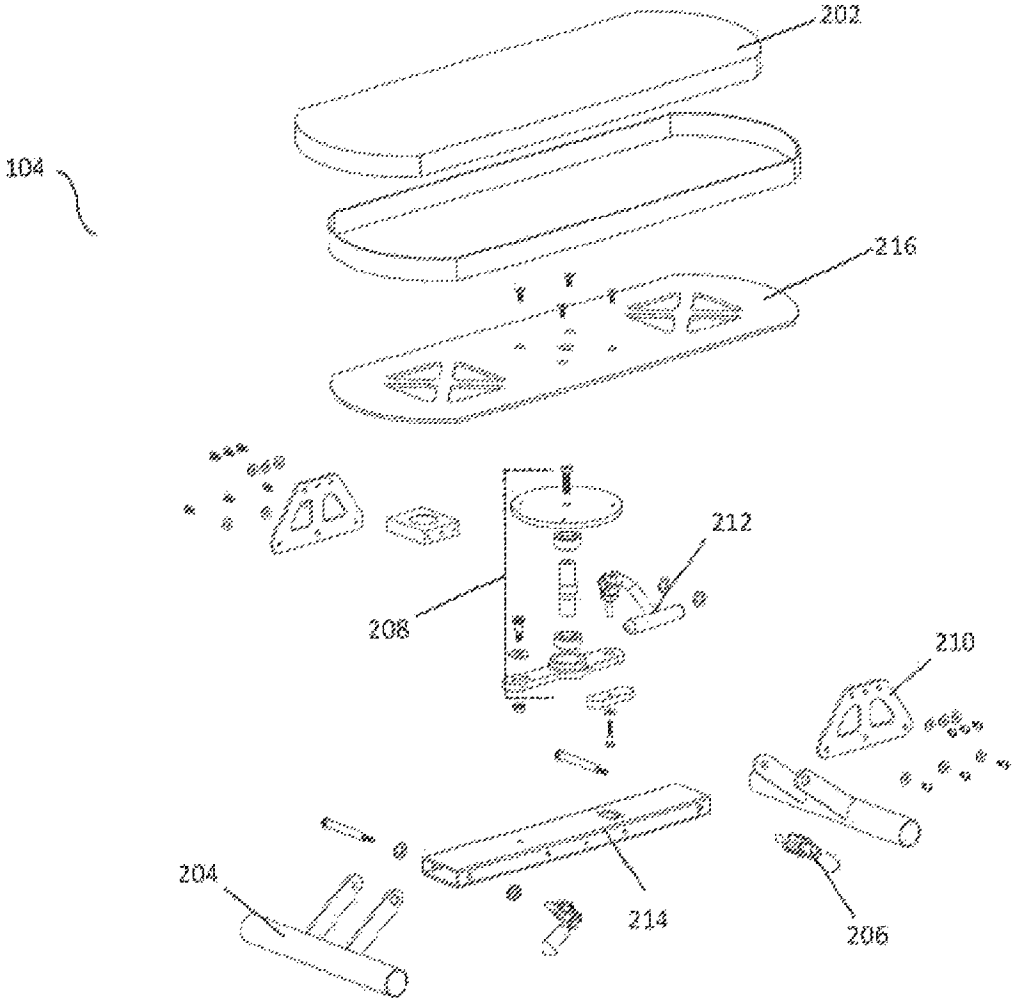

FIG. 7 is an exploded view of ball platform 104 illustrating the construction details of ball platform 104. Ball surface 202 is coupled to ball surface support plate 216. Ball surface support plate 216 is coupled to ball surface connector 208. Ball surface connector 208 may be comprised of a support plate connector and a platform base connector with a rotatable support means therebetween. The rotatable support means of ball surface connector 208 enables ball surface 202 to be rotatably positioned. Ball surface connector 208 may be coupled to ball platform base 214.

Ball surface adjustment handle 212 is operably connected to ball surface connector 208 and ball platform base 214, such that ball surface adjustment handle 212 may lock ball surface connector 208 in a desired position when engaged. Ball surface support bracket 210 is coupled to ball platform base 214 and ball surface connector 208 to provide stabilizing support to ball surface connector 208. Ball platform support legs 204 are pivotably coupled to ball platform base 214. Support leg locks 206 are operably connected to ball platform support legs 204 and ball platform base 214, such that ball platform support legs 204 may be configured to a desired position and locked in place.

A user may use embodiments of the present disclosure in a variety of use cases, locations, and with or without golf balls. The portability of the invention makes it easy to use inside or outside. Preferred locations for use include golf driving ranges, back yards, open fields, indoor golf facilities or personal residences. Embodiments of the present disclosure solve the problem of poor ball strikes resulting from challenging and/or unusual balance issues. The primary use cases for the invention are as an uneven golf lie trainer, a coaching aid to improve swing flaws, and a balance aid device.

Embodiments of the present disclosure could be utilized to help rehabilitation patients recovering from an injury. In such cases, a patient would stand on the foot platform and go through rehabilitation processes with a physical therapist to improve balance and strength. Alternative embodiments may provide for a motorized actuator to automatically adjust the positioning of the foot platform and/or the ball platform.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention.

What is claimed is:

1. A golf training apparatus comprising:

a foot platform, the foot platform comprising an independent right foot surface and an independent left foot surface, a right foot adjustment means and a left foot adjustment means operably engaged with the independent right foot surface and the independent left foot surface such that the independent right foot surface and the independent left foot surface may be independently configured to a desired position, a foot platform base coupled to the right foot adjustment means and the left foot adjustment means, an adjustable foot platform support means coupled to the foot platform base, and at least two wheels coupled to the foot platform base, the adjustable foot platform support means being configured to elevate the at least two wheels from the ground and selectively position the foot platform base to a desired height; and, a ball platform, the ball platform comprising a ball surface, a ball surface adjustment means coupled to the ball surface, a ball platform base coupled to the ball surface adjustment means, and an adjustable ball platform support means coupled to the ball platform base.

2. The golf training apparatus of claim 1 further comprising a locking means coupled to the right foot adjustment means and the left foot adjustment means.

3. The golf training apparatus of claim 1 further comprising an extendable handle coupled to the foot platform base.

4. The golf training apparatus of claim 1 further comprising a handle operably coupled to the ball surface adjustment means.

* * * * *